US006042491A

United States Patent [19]

Dixon, Jr.

[11] Patent Number: 6,042,491

[45] Date of Patent: Mar. 28, 2000

[54] BALL PROPELLING AND BATTING APPARATUS

[76] Inventor: Nicholas E. Dixon, Jr., 4007 Neyman Rd., Albertville, Ala. 35950

[21] Appl. No.: 09/119,710

[22] Filed: Jul. 20, 1998

Related U.S. Application Data

[60] Provisional application No. 60/053,666, Jul. 24, 1997.

[51] Int. Cl.[7] ..... A63B 69/00

[52] U.S. Cl. ..... 473/423; 473/424; 473/428; 473/457; 473/458; 473/468

[58] Field of Search ..... 473/423, 424, 473/425, 426, 427, 428, 429, 430, 506, 507, 508, 615, 451, 450, 458, 464, FOR 108, FOR 109, FOR 160, FOR 197, FOR 198, FOR 199, FOR 213, FOR 214, 457, 468; 273/451, 453, 440, 329, 330, 331–335; 446/247–253, 228; 482/110, 92

[56] References Cited

U.S. PATENT DOCUMENTS

| | | |
|---|---|---|
| 2,988,846 | 6/1961 | Samuel . |
| 3,011,784 | 12/1961 | Segretto . |
| 3,042,401 | 7/1962 | Denegre . |
| 3,310,306 | 3/1967 | Burt . |
| 3,469,840 | 9/1969 | Kruzel . |
| 3,550,937 | 12/1970 | Wright et al. . |
| 3,558,134 | 1/1971 | Hoitsma . |
| 3,754,761 | 8/1973 | Pruss . |
| 3,893,256 | 7/1975 | Wolf . |
| 3,953,026 | 4/1976 | Stokely . |
| 4,080,750 | 3/1978 | Palumbo . |
| 4,944,513 | 7/1990 | Zentner . |
| 4,964,634 | 10/1990 | Boyer . |

OTHER PUBLICATIONS

Advertisment for "The Official Ultra Zoom Ball", 4 pages, manufactured by Pressman; Stock No. 6002; as advertised at WalMart Stores, no date.

Advertisement for "Micro Power Ball", 2 pages, distributed by Polyfect Toys Co., Ltd, Kowloon, Honk Kong; Stock No. 3306; as advertised at WalMart Stores, no date.

*Primary Examiner*—Sebastiano Passaniti

[57] ABSTRACT

A ball propelling and batting apparatus includes a pair of lines, a pair of handles, a ball, a bat with a hitting portion having a flat longitudinal surface, an attachment member and stoppers. The handles are attached to first ends of the lines. The ball is mounted to the lines for undergoing sliding movement therealong when the lines are pulled laterally away from one another. The bat is swung so that the flat surface moves parallel to the lines to bring the bat into proper contact the ball. The attachment member fastens second ends of the lines to an anchor. The stoppers are attached to the handles such that the ball sliding along the lines is prevented from contacting the handles. The ball can have an outer shell defining a hollow interior chamber and a plurality of holes and tubular inserts securely fitted through a pair of opposite aligned ones of the holes and receiving the lines therethrough. The apparatus further includes another stopper mounted to the lines between the ball and anchor such that the ball sliding along the lines is prevented from contacting the anchor and a third line extending between and attached to the stopper and the anchor or a catching mit for receiving the ball.

26 Claims, 3 Drawing Sheets

BALL PROPELLING AND BATTING APPARATUS

This application claims the benefit of U.S. provisional application No. 60/053,666, filed Jul. 24, 1997.

BACKGROUND OF THE INVENTION

1. Field of the Invention

The present invention generally relates to baseball practice and, more particularly, is concerned with a ball propelling and batting apparatus.

2. Description of the Prior Art

Baseball players often will practice batting to improve their performance during a game. A batter generally must have a pitcher, catcher and fielder to practice. The pitcher must be able to throw pitches which are hitable. The catcher must be able to catch balls which the batter does not hit. The fielder must be able to retrieve balls which the batter does hit. A problem may arise, however, if the batter wishes to practice but one or more of these three players are not available because no one can be found who is sufficiently skilled at one or more of these three positions. In this event, a batter must have an alternative means to enable him or her to practice in the presence of individuals who are not able to throw, catch and/or field well enough to participate in a game.

A variety of devices have been developed over the years which enable a batter to practice with assistance from those who are not skilled in the game. Some of these devices employ a ball attached to an end of or movable along a rope or string which can be thrown and/or struck by a bat. Representative examples of these devices and the like are disclosed in U.S. Pat. No. 3,469,840 to Kruzel, U.S. Pat. No. 3,550,937 to Wright, U.S. Pat. No. 3,558,134 to Hoitsma, U.S. Pat. No. 3,754,761 to Pruss, U.S. Pat. No. 3,953,026 to Stokely and U.S. Pat. No. 4,944,513 to Zentner. None of these prior art designs, however, appear to provide an optimum solution with the least expense in manufacture and the least complexity in use.

Consequently, a need still exists for an apparatus which provides a solution to the aforementioned problem in the prior art without introducing any new problems in place thereof.

SUMMARY OF THE INVENTION

The present invention provides a ball propelling and batting apparatus designed to satisfy the aforementioned need. The ball propelling and batting apparatus of the present invention is simple, portable and inexpensive to manufacture. The ball propelling and batting apparatus can be used by those of only minimal skill in baseball and/or related games. Such capability will solve the aforementioned problem with the prior art designs by enabling a ball to be propelled and batted along a pair of lines. The term "lines" is meant in a generic sense to include stings and the like. The ball propelling and batting apparatus permits a ball to be repetitively and easily pitched as a strike without the propeller having much skill. The ball sliding along the lines may be struck by a batter. A fielder is not used, though one may participate as a catcher. The apparatus is self-contained and can be used indoors or outside.

Accordingly, the present invention is directed to a ball propelling and batting apparatus which comprises: (a) a pair of lines, each line having first and second ends; (b) a ball slidably mounted to the lines; (c) a pair of handles, each handle being attached to the first end of one of the lines, the handles being adapted for holding by a pitcher to cause movement of the ball along the lines toward the second ends thereof upon pulling of the lines laterally away from one another by the pitcher; (d) a bat adapted for swinging by a hitter to hit the ball and cause movement of the ball along the lines toward the first ends thereof; and (e) means for attaching the second ends of the lines to an anchor. The bat has a handle portion and an elongated ball hitting portion extending from the handle portion. The ball hitting portion has an elongated flat longitudinal surface formed thereon to allow proper contact of the ball hitting portion with the ball by the flat surface moving generally parallel to and along the lines when the hitter swings the bat to hit the ball. Each line can be braided into the form of a cord. Each line has a length and a diameter substantially the same as the length and diameter of the other line. Each handle has a substantially D-shaped configuration.

The apparatus further comprises a pair of stoppers. Each stopper is attached to one of the handles such that the ball sliding along the lines is prevented from contacting the handles by the stoppers. Each stopper has a substantially U-shaped configuration.

The ball has an outer shell of a substantially spherical configuration and defines a hollow interior chamber. The outer shell of the ball defines a plurality of holes. The apparatus further comprises a tubular insert securely fitted through a pair of the holes opposite from and aligned with one another and receiving the lines therethrough. Alternatively, the apparatus comprises a pair of tubular inserts. Each tubular insert is securely fitted through one of the pair of holes of the ball. Alternatively, the ball has a substantially semi-spherical configuration and defines a central passageway receiving the lines therethrough.

The attaching means includes a clip member substantially in the form of a ring. The apparatus further comprises a stopper substantially in the form of a washer and slidably mounted to the lines between the ball and the anchor or mounted to the second ends of the lines such that the ball sliding along the lines is prevented from contacting the anchor. The apparatus further comprises a third line extending between the washer and the anchor and having first and second ends. The first end of the third line is attached to the washer and the second end of the third line is attached to the anchor. The third line may be braided into the form of a cord. The third line has a length substantially less than the length of each of the other lines and a diameter substantially the same as the diameter of each of the other lines.

The apparatus further comprises a catching mit having opposite front and rear sides and for receiving the ball. The front side of the catching mit has a substantially concave configuration. The catching mit has a tab defining an aperture therethrough mounted on the front side of the catching mit. The attaching means includes a clip member substantially in the form of a ring mounted through the aperture of the tab of the catching mit. The rear side of the catching mit has a substantially convex configuration. The catching mit has a handle mounted on the rear side of the catching mit. The handle of the catching mit has a substantially inverted U-shaped configuration.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
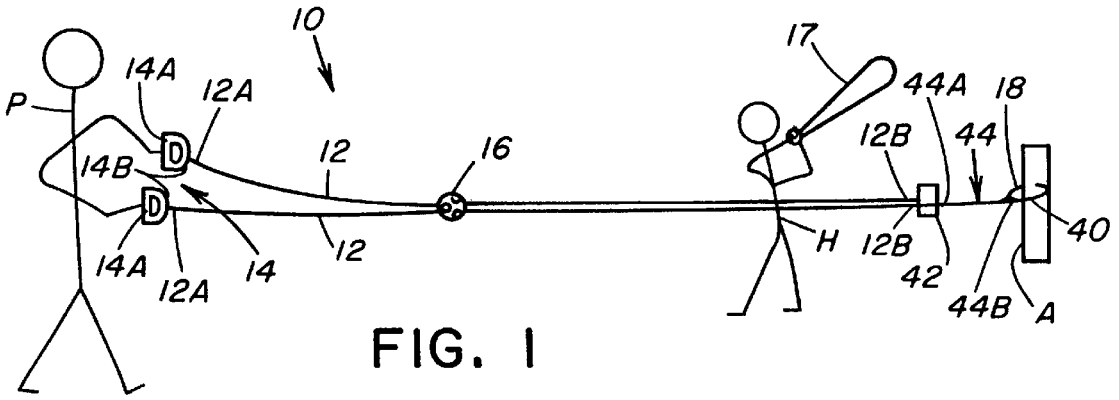
FIG. 1 is a schematic view of a ball propelling and batting apparatus of the present invention employing an anchor.
Figure 2:
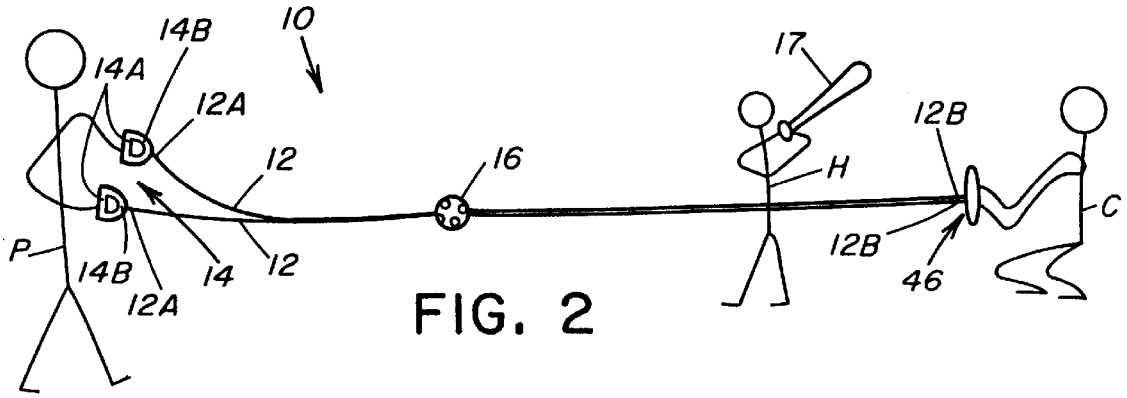
FIG. 2 is a schematic view of the ball propelling and batting apparatus employing a catcher.
Figure 3:
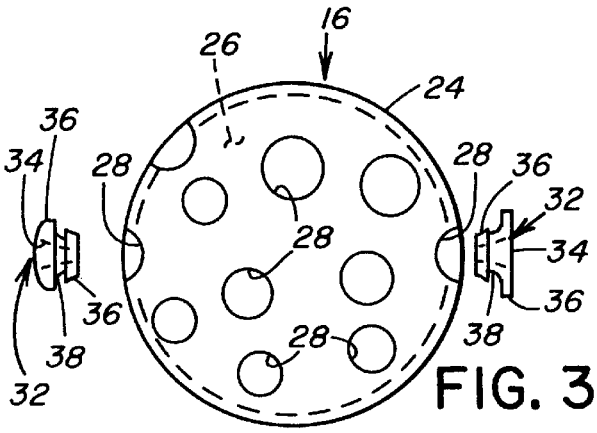
FIG. 3 is an enlarged exploded side elevational view of a ball and a pair of tubular inserts of the apparatus.
Figure 5:
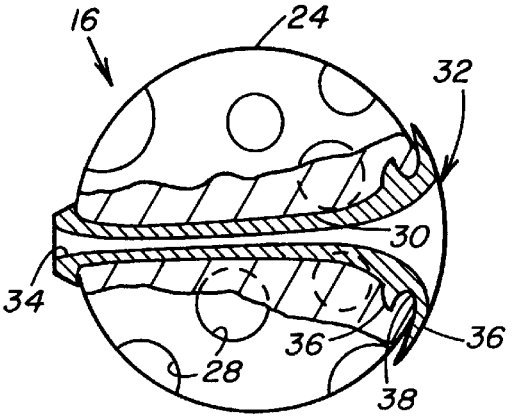
FIG. 5 is an enlarged side elevational view of a ball and a single tubular insert of the apparatus.
Figure 4:
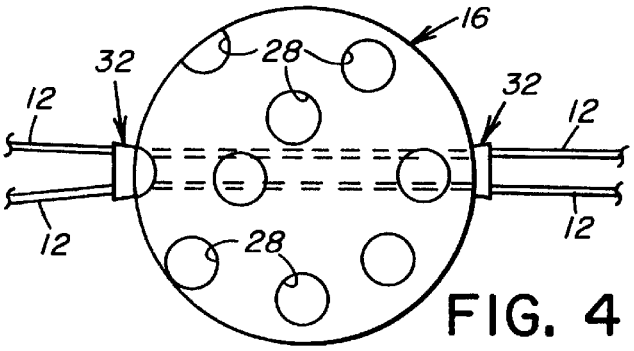
FIG. 4 is an assembled side elevational view of the ball and tubular inserts of the apparatus of FIG. 3 shown slidably mounted to a pair of lines of the assembly.
Figure 6:
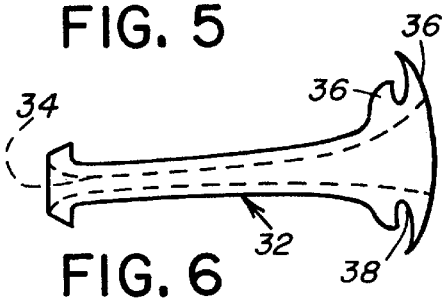
FIG. 6 is a side elevational view of the single tubular insert of the apparatus of FIG. 5 detached from the ball of the apparatus.
Figure 7:
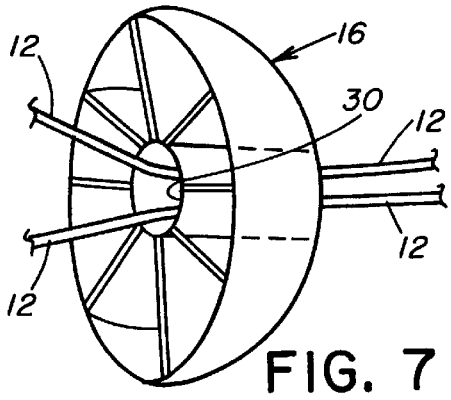
FIG. 7 is an enlarged side elevational view of the ball of the apparatus having a substantially semi-spherical configuration.

Referring to the drawings and particularly to FIGS. 1 and 2, there is illustrated a ball propelling and batting apparatus, generally designated 10, of the present invention. Basically, the ball propelling and batting apparatus 10 includes a pair of lines 12, a pair of handles 14, a ball 16, a bat 17, and attaching means 18. Each line 12 has first and second ends 12A, 12B. Each handle 14 is attached to the first end 12A of one of the lines 12. The ball 16 is slidably mounted to the lines 12 for movement therealong and for hitting by the bat 17. The attaching means 18 fastens the second ends 12B of the lines 12 to an anchor A. Two people are needed to operate the apparatus 10, a pitcher P and a batter or hitter H, as shown in FIG. 1. A third person can participate as a catcher C, as shown in FIG. 2.

In operation, the pitcher P grips both handles 14 and separates and pulls the handles 14 and thus the lines 12 connected thereto laterally apart from one another to cause propelling of the ball 16 toward the anchor A. The speed of the ball 16 over the lines 12 is determined by how slow or fast the pitcher P moves the handles 14 apart from one another. The hitter H swings the bat 17 at the ball 16 being propelled and hits the ball 16 back toward the pitcher P. The pitcher P may keep the handles 14 apart to bring the ball 16 to a stop at a point on the lines 12 spaced from the handles 14.

Referring now to FIGS. 1, 2, 4, 7 and 8, each line 12 is comprised of a suitable material, for instance a plastic material such as substantially polypropylene or polyethylene, which may be braided or twisted into the form of a cord, though it may be comprised of any other suitable material, and have any other suitable form. Each line 12 has a length and a diameter which is substantially the same as the length and diameter of the other line 12. As an example, the diameter of each line can be 1/16 of an inch, but may be of any other suitable size. Each line 12 may have wax or any other suitable substance applied thereover to facilitate movement of the ball 16 therealong.

Figure 8:
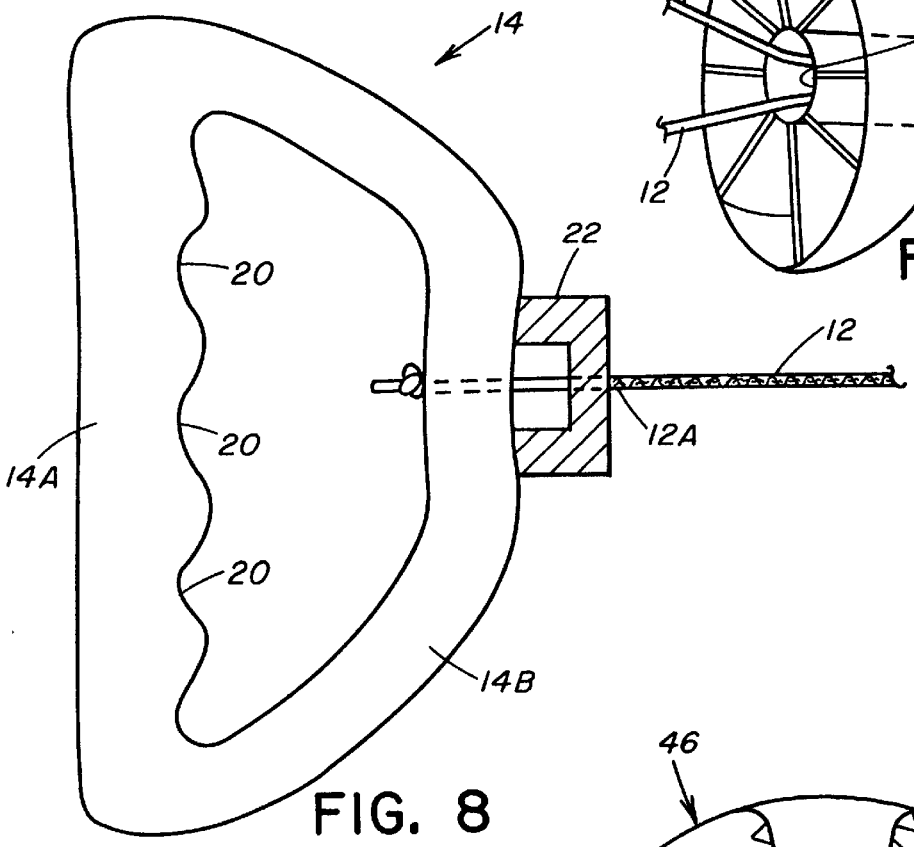
FIG. 8 is an enlarged side elevational view of a handle and stopper mounted to an end of a line of the apparatus.

Referring now to FIGS. 1, 2 and 8, each handle 14 is preferably comprised of a substantially plastic material, though may be comprised of any other suitable material. Each handle 14 has a substantially D-shaped configuration with a rear straight portion 14A and a front curved portion 14B, though it may have any other suitable configuration. The rear straight portion 14A is for gripping by the pitcher P. The rear straight portion 14A defines a plurality of recesses 20 for receiving fingers of the pitcher P, as shown particularly in FIG. 8. The first end 12A of one of the lines 12 is attached to the front curved portion 14B of one of the handles 14.

The apparatus 10 may further include a pair of stoppers 22, as shown particularly in FIG. 8. Each stopper 22 is attached to one of the handles 14 such that the ball 16 sliding along the lines 12 is prevented from contacting the handles 14. Each stopper 22 is attached by any suitable means, such as by one or more screw fasteners, particularly to the front curved portion 14B of one of the handles 14. Each stopper 22 is preferably comprised of a substantially rubber material, though it may be comprised of any other suitable material. Each stopper 22 has a substantially U-shaped configuration, though may have any other suitable configuration. Each stopper 22 functions as an absorber of shock which may result if the ball 16 is allowed to directly contact the handles 14.

Referring now to FIGS. 1 to 7, the ball 16 preferably is comprised of a substantially plastic material, though it may be comprised of any other suitable material. The ball 16 preferably has a substantially spherical configuration. The ball 16 may alternatively have a substantially semi-spherical configuration, as shown particularly in FIG. 7, or any other suitable configuration. The ball 16 has an outer shell 24 and defines a hollow interior chamber 26. The outer shell 24 has any suitable diameter. In the spherical configuration, the outer shell 24 defines a plurality of holes 28, preferably of circular shape. The holes 28 may be spaced any suitable distance away from one another and have any suitable arrangement about the outer shell 24, though each hole 28 should be aligned with another hole 28 on an opposite side of the outer shell 24. The holes 28 may be of any suitable number and size, though must be at least large enough to receive the lines 12 therethrough.

In the semi-spherical configuration, the ball 16 defines a central passageway 30 for receiving the lines 12 therethrough. The central passageway 30 has a substantially circular configuration, though may have any other suitable shape, and has any suitable size, though must be at least large enough to receive the lines 12 therethrough.

The apparatus 10 may further include one or a pair of tubular inserts 32, as shown particularly in FIGS. 3 to 6. Each tubular insert 32 is preferably comprised of a substantially plastic material, though may be comprised of any other suitable material. Each tubular insert 32 defines a longitudinal passageway 34 therethrough. The lines 12 are received through the longitudinal passageway 34. If only a single tubular insert 32 is provided, as shown particularly in FIGS. 5 and 6, the tubular insert 32 is securely fitted through a pair of opposite and aligned holes 28 of the ball 16. If a pair of tubular inserts 32 are provided, as shown particularly in FIGS. 3 and 4, each tubular insert 32 is securely fitted through one of a pair of opposite and aligned holes 28 of the ball 16. Each tubular insert 32 protects the outer shell 24 of the ball 16 and allows the ball 16 to travel more easily with less frictional resistance along the lines 12. Each tubular insert 32 defines a pair of adjacent annular lips 36 forming a recess 38 therebetween at one or both ends thereof. The recess 38 receives and traps therein rim portions of the outer shell 24 of the ball 16 surrounding the pair of opposite and aligned holes 28 and thereby secures the tubular insert 32 to the ball 16. The central passageway 30 may be fitted with a single tubular insert 32.

Figure 9:
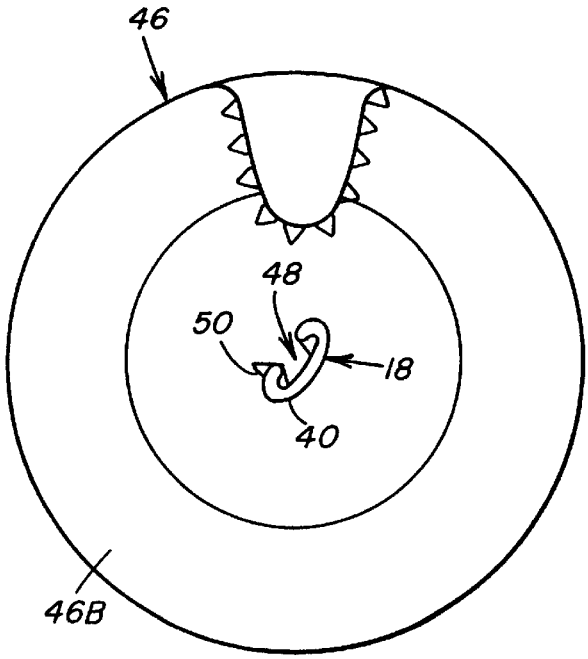
FIG. 9 is an enlarged front elevational view of a catching mit of the apparatus.

Referring now to FIGS. 1 and 9, the attaching means 18 includes a clip member 40 substantially in the form of a ring or in the form of any other suitable element. The clip member 40 may be comprised of any suitable material. The clip member 40 is attached to the anchor A and to the second ends 12B of the lines 12 and thereby fastens the second ends 12B of the lines 12 to the anchor A. The anchor A may be a post, tree, door knob or any other suitable element.

The apparatus 10 may further include a stopper 42, as shown particularly in FIG. 1. The stopper 42 is substantially in the form of a washer or the like and is slidably mounted to the lines 12 between the ball 16 and the anchor A such that the ball 16 sliding along the lines 12 is prevented from contacting the anchor A. The stopper 42 is preferably comprised of a substantially rubber material, though it may be comprised of any other suitable material. The stopper 42 functions as an absorber of shock which may result if the ball 16 is missed by the hitter H and contacts the attaching means 18 or anchor A. The stopper 42 may, alternatively, be mounted to the second ends 12B of the lines 12 such that the ball 16 sliding along the lines 12 is prevented from contacting the anchor A. The apparatus 10 may further include a third line 44 extending between the stopper 42 and the anchor A. The third line 44 has first and second ends 44A, 44B. The first end 44A is attached to the stopper 42. The second end 44B is attached to the anchor A. The third line 44 is preferably also comprised of a substantially polypropylene or polyethylene material which is braided or twisted into the form of a cord, though may be comprised of a plastic material, or any other suitable material, and have any other suitable form, and may or may not be comprised of the same material and have the same form as the lines 12. The third line 44 has a length substantially less than the length of each of the lines 12, though may have any other suitable length. The third line 44 has a diameter which is substantially the same as the diameter of each of the lines 12, such as 1/16 of an inch, though may be of any other suitable size.

Figure 10:
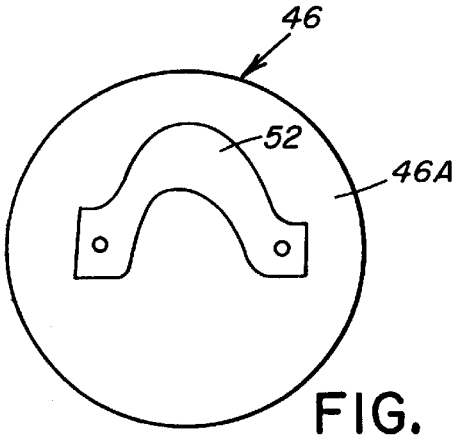
FIG. 10 is a rear elevational view of the catching mit of FIG. 9 shown on a reduced scale.

Referring now to FIGS. 2, 9 and 10, the apparatus 10 may further include a catching mit 46. The catching mit 46 has opposite front and rear sides 46A. 46B. The front side 46A has a substantially concave configuration. The rear side 46B has a substantially convex configuration. The catching mit 46 has a tab 48 defining an aperture 50 therethrough mounted at a center and on the front side 46A of the catching mit 46. The attaching means 18 includes the clip member 40 substantially in the form of a ring mounted through the aperture 50 of the tab 48 of the catching mit 46. The catching mit 46 has a handle 52 mounted at the center and on the rear side 46B of the catching mit 46. The handle 52 of the catching mit 46 has a substantially inverted U-shaped configuration. The catching mit 46 is comprised of a substantially plastic material, though may be comprised of any other suitable material. The handle 52 is gripped by the catcher C.

Figure 11:
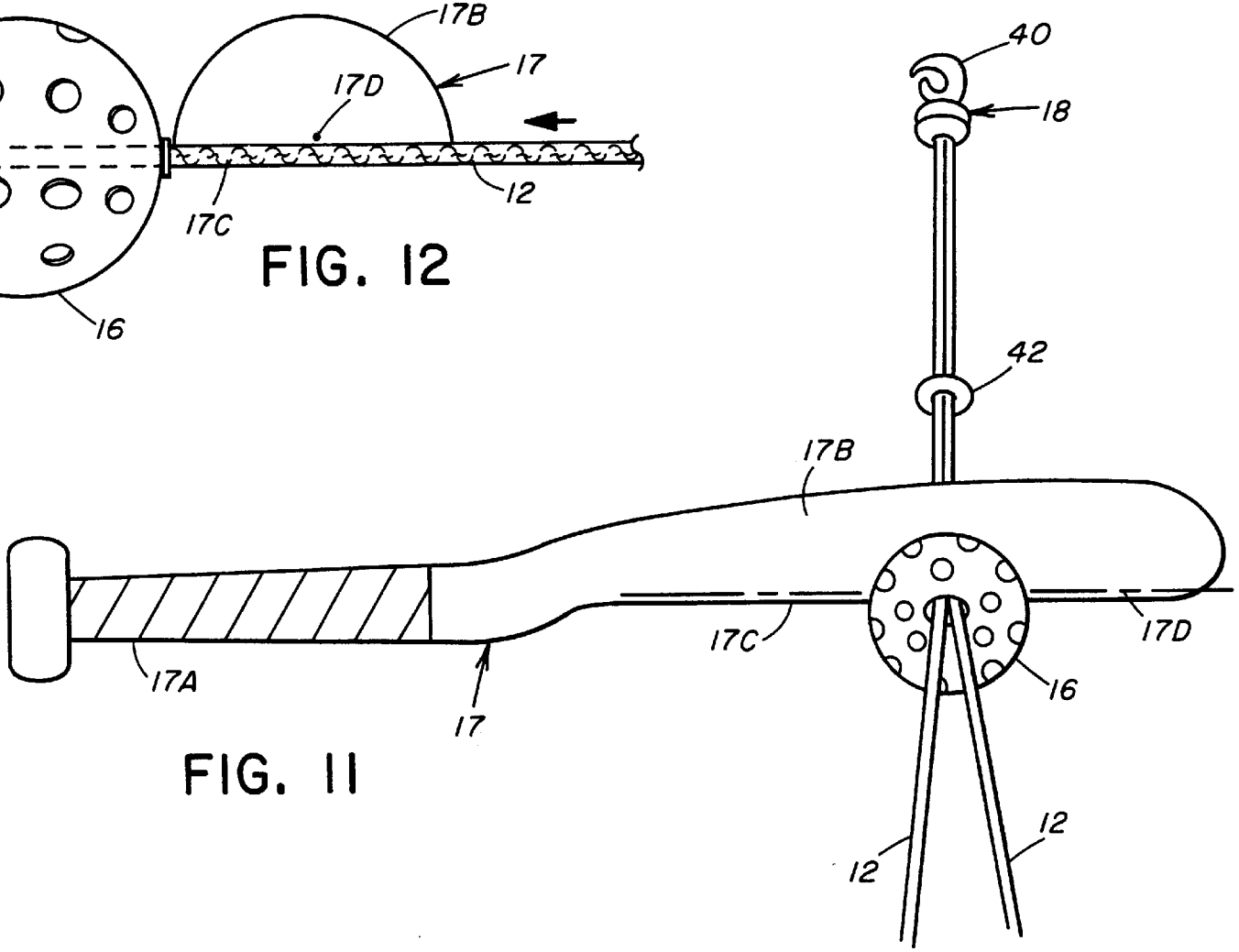
FIG. 11 is an enlarged side elevational view of a bat of the apparatus making contact with the ball of the apparatus.
Figure 12:
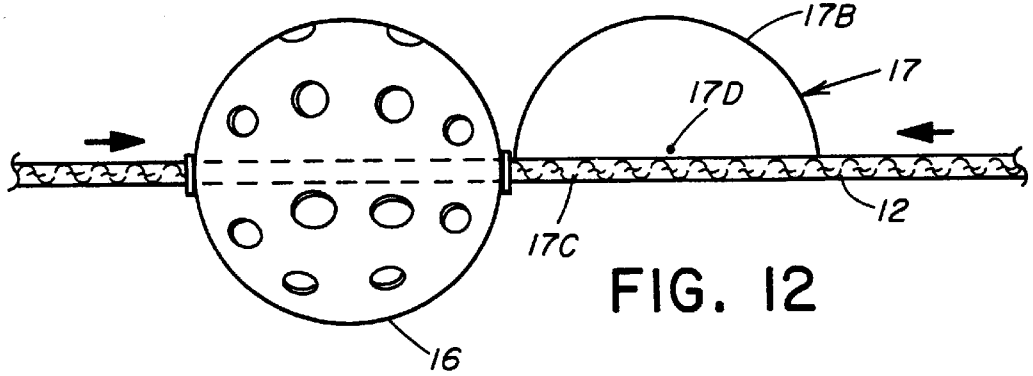
FIG. 12 is an cross-sectional view of the bat hitting the ball taken along line 12—12 of FIG. 11.

Finally, FIGS. 11 and 12 show the bat 17 is adapted for swinging by the hitter H to hit the ball 16 and cause movement of the ball 16 along the lines 12 toward the first ends 12A thereof. The bat 17 has a handle portion 17A and an elongated ball hitting portion 17B merging and extending from the handle portion 17A. The handle portion 17A is circular in cross-section while the ball hitting portion 17B is semi-circular in cross-section. The ball hitting portion 17B has an elongated flat longitudinal surface 17C formed thereon so as to intersect at or near to the longitudinal centerline 17D of the bat 17 to allow proper contact of the ball hitting portion 17B with the ball 16 by the flat surface 17C being movable generally parallel to and along the lines 12 when the hitter E swings the bat 17 to hit the ball 16. In other words, the bat 17 has a "top half" design allowing the bat's flat bottom surface 17C to "glide" along the lines 12 and line up with the center of the ball 16 allowing center-to-center contact between the bat 17 and ball 16 which gives the hitter H an enhanced sensation of hitting a "real" baseball. The bat 17 may be made of a suitable material such as plastic or metal.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A ball propelling and batting apparatus, comprising:

(a) a pair of lines, each line having first and second ends;

(b) a ball slidably mounted to said lines;

(c) a pair of handles, each handle being attached to said first end of one of said lines, said handles adapted for holding by a pitcher to cause movement of said ball along said lines toward said second ends thereof upon pulling of said lines laterally away from one another by said pitcher;

(d) a bat adapted for swinging by a hitter to hit said ball and cause movement of said ball along said lines toward said first ends thereof; and (e) means for attaching said second ends of said lines to an anchor.

2. The apparatus of claim 1 wherein said bat has a handle portion and an elongated ball hitting portion extending from said handle portion, said ball hitting portion having an elongated flat longitudinal surface formed thereon for moving generally parallel to and along said lines when the hitter swings said bat to hit said ball.

3. The apparatus of claim 1 wherein each of said lines has a length and a diameter substantially the same as said length and diameter of the other of said lines.

4. The apparatus of claim 1 wherein each of said handles has a substantially D-shaped configuration.

5. The apparatus of claim 1 further comprising:

a pair of stoppers, each said stopper being attached to one of said handles such that said ball sliding along said lines is prevented from contacting said handles by said stoppers.

6. The apparatus of claim 5 wherein each of said stoppers has a substantially U-shaped configuration.

7. The apparatus of claim 1 wherein said ball has a substantially spherical configuration.

8. The apparatus of claim 1 wherein said ball has an outer shell and defines a hollow interior chamber.

9. The apparatus of claim 8 wherein said outer shell of said ball defines a plurality of holes.

10. The apparatus of claim 9 further comprising:

a tubular insert securely fitted through a pair of said holes of said ball being opposite from and aligned with one another and receiving said lines therethrough.

11. The apparatus of claim 9 further comprising:

a pair of tubular inserts, each tubular insert securely fitted through one of a pair of said holes of said ball being opposite from and aligned with one another and receiving said lines therethrough.

12. The apparatus of claim 1 wherein said ball has a substantially semi-spherical configuration and defines a central passageway receiving said lines therethrough.

13. The apparatus of claim 1 wherein said attaching means includes a clip member substantially in the form of a ring.

14. The apparatus of claim 1 further comprising:

a stopper substantially in the form of a washer and slidably mounted to said lines between said ball and the anchor such that said ball sliding along said lines is prevented from contacting the anchor.

15. The apparatus of claim 1 further comprising:

a stopper substantially in the form of a washer and mounted to said second ends of said lines and such that said ball sliding along said lines is prevented from contacting the anchor.

16. The apparatus of claim 15 further comprising:

a third line extending between said stopper and the anchor and having first and second ends, said first end of said third line being attached to said stopper and said second end of said third line being attached to the anchor.

17. The apparatus of claim 16 wherein said third line is braided into the form of a cord.

18. The apparatus of claim 16 wherein said third line has a length substantially less than said length of each of the other said lines.

19. The apparatus of claim 16 wherein said third line has a diameter substantially the same as said diameter of each of the other said lines.

20. The apparatus of claim 1 further comprising:

a catching mit having opposite front and rear sides and having a configuation for receiving said ball.

21. The apparatus of claim 20 wherein said configuration at said front side of said catching mit is substantially concave.

22. The apparatus of claim 20 wherein said catching mit has a tab defining an aperture therethrough mounted on said front side of said catching mit.

23. The apparatus of claim 20 wherein said attaching means includes a clip member substantially in the form of a ring mounted through said aperture of said tab of said catching mit.

24. The apparatus of claim 20 wherein said configuration at said rear side of said catching mit is substantially convex.

25. The apparatus of claim 20 wherein said catching mit has a handle mounted on said rear side of said catching mit.

26. The apparatus of claim 25 wherein said handle of said catching mit has a substantially inverted U-shaped configuration.

* * * * *